US006446699B1

(12) United States Patent
Schober

(10) Patent No.: US 6,446,699 B1
(45) Date of Patent: Sep. 10, 2002

(54) COOLING WATER PUMP

(75) Inventor: Martin Schober, Molln (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 41 days.

(21) Appl. No.: 09/711,871

(22) Filed: Nov. 14, 2000

(30) Foreign Application Priority Data

Nov. 19, 1999 (AT) ..... 1966/99

(51) Int. Cl.[7] ..... B22D 27/00; F04D 29/12

(52) U.S. Cl. ..... 164/113; 415/168.2; 415/169.1; 123/41.44

(58) Field of Search ..... 415/168.1, 169.1, 415/168.2; 417/362, 364; 123/41.44; 164/113, 312

(56) References Cited

U.S. PATENT DOCUMENTS 3,001,517 A * 9/1961 Baker et al. ..... 415/168.2
5,125,795 A 6/1992 Suzuki et al.
5,950,577 A * 9/1999 Sasaki et al. ..... 415/168.1
6,270,312 B1 * 8/2001 Heer ..... 415/168.2

FOREIGN PATENT DOCUMENTS

DE 2846950 5/1979

OTHER PUBLICATIONS

Patent Abstracts of Japan abstract of JP 08 218871 A, dated Aug. 27, 1996, entitled "Water Pump for Water–Cooled Engine".

* cited by examiner

*Primary Examiner*—Christopher Verdier
(74) *Attorney, Agent, or Firm*—Dykema Gossett PLLC

(57) ABSTRACT

A cooling water pump, for an internal-combustion engine in particular, with a casing provided with at least one bearing designed to support a pump shaft, with a sealing element devised to seal the bearing against a working space containing the cooling agent as well as with a leakage chamber arranged in the casing and receiving the cooling agent that leaks through the sealing element. A particularly simple way of production is achieved by the fact that the leakage chamber may be brought out of shape by a slider pulled in an essentially transverse direction and preferably normal to the plane on the axis of the pump shaft.

8 Claims, 3 Drawing Sheets

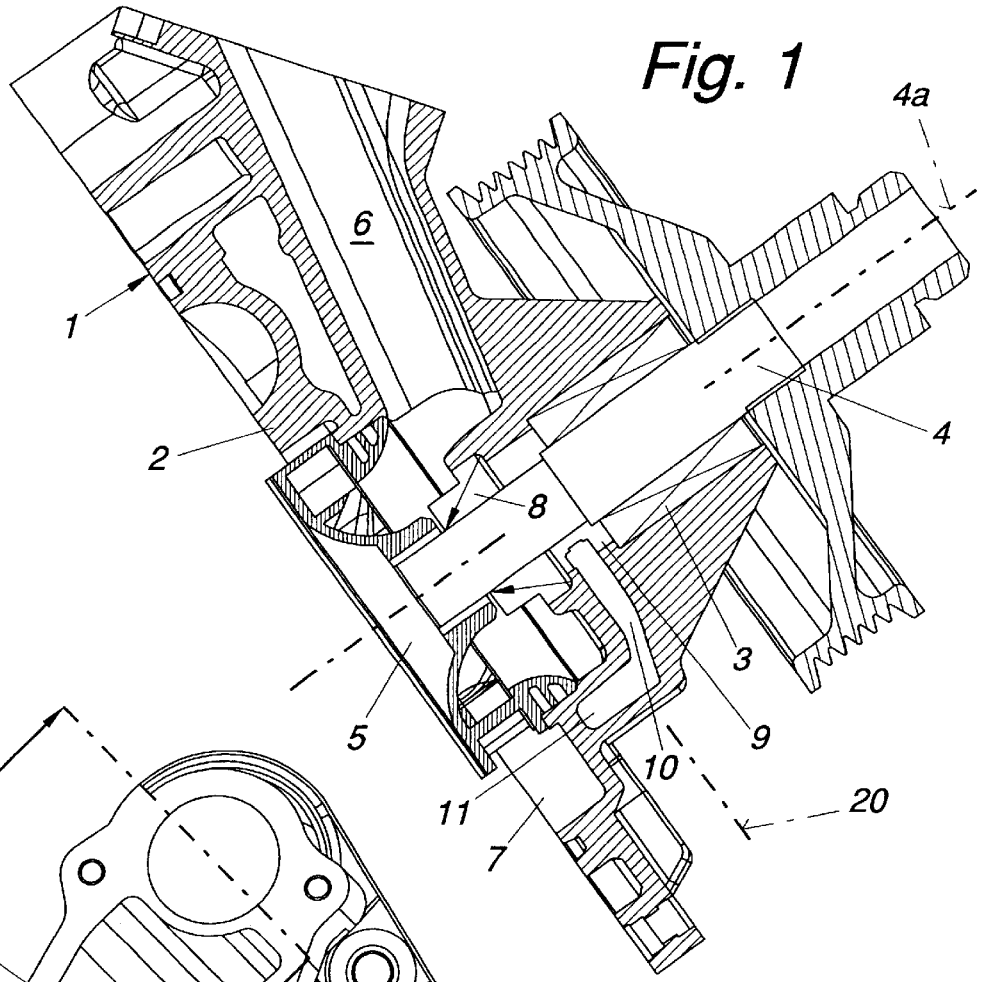
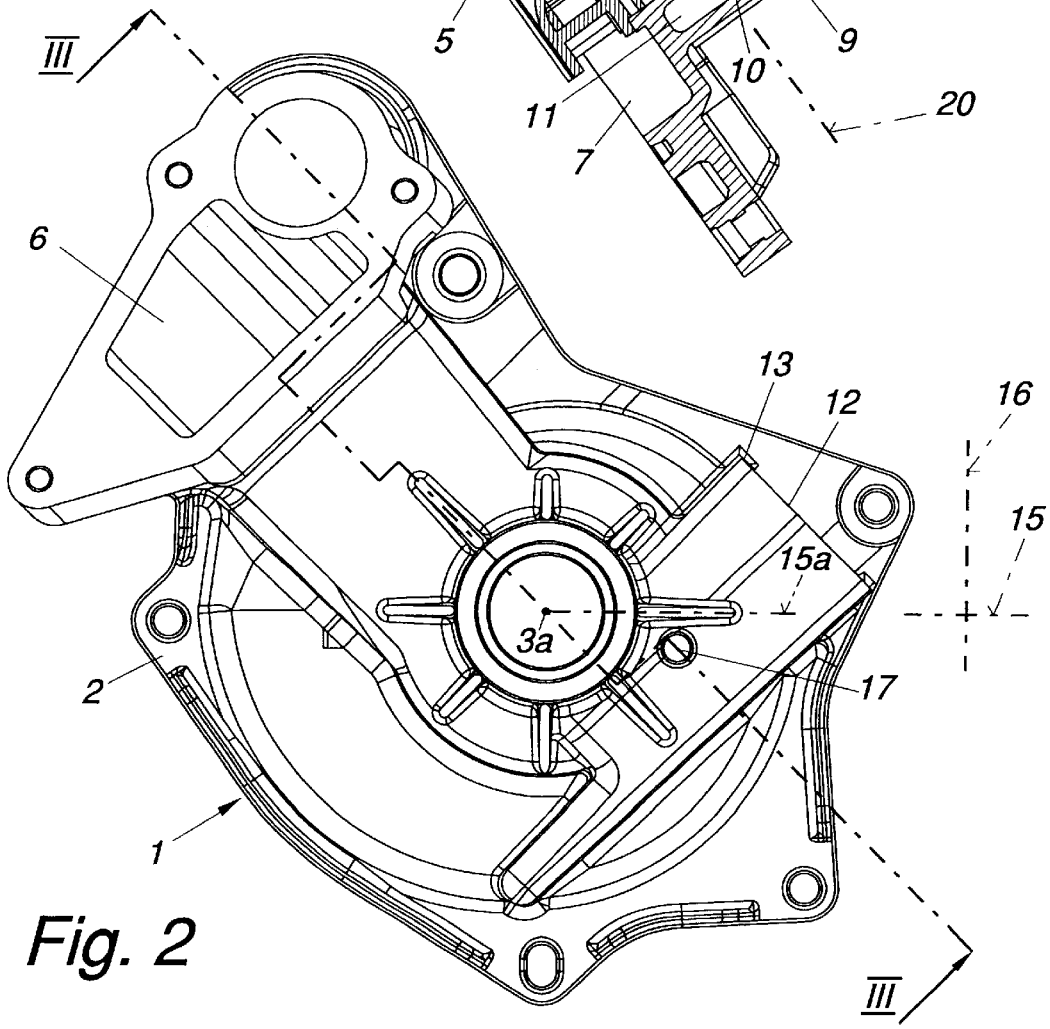
Fig. 2

COOLING WATER PUMP

BACKGROUND OF THE INVENTION

The invention relates to a cooling water pump, for an internal-combustion engine in particular, with a casing provided with at least one bearing designed to support a pump shaft, with a sealing element devised to seal the bearing against a working space containing the cooling agent as well as with a leakage chamber arranged in the casing and receiving the cooling agent that leaks through the sealing element.

Cooling water pumps in motor vehicles are exposed to relatively critical working conditions. Long rest periods and great variations in temperature are to be overcome and maintenance-free operation over a long period of time is taken for granted. In practice it proved to be almost impossible to achieve a perfectly tight sealing of the pump though, i.e., the oozing of small amounts of the cooling agent must always be taken into account. It is however unwanted to let this quantify of leakage run out of the pump without further ado, since this would produce the impression that there is a flaw.

DESCRIPTION OF PRIOR ART

The former Austrian Patent Application No. 773/99 by the same applicant discloses a cooling water pump provided with a leakage chamber that may be brought out of shape in direction of the axis of the pump shaft and that is located, in fitting position, underneath the pump shaft. The leakage chamber has an opening to the outside which is at least partially closed by a cover, e.g., by a metal foil. Merely a small opening remains open, through which water vapor may escape or through which cooling water leaking through a failing rotating mechanical seal may overflow. Since the leakage chamber must be tight, the cover has to be glued and additionally calked. An additional communicating bore is needed in order to connect the leakage chamber with the space located between the bearing and the rotating mechanical seal. This leakage chamber is accordingly very complicated in construction and its cost is high.

The document DE 28 46 950 B1 describes a coolant pump for liquid-cooled internal combustion engines with a leakage chamber arranged in a casing and receiving a coolant agent. The leakage chamber designed as evaporation room is formed by a bored blind whole which is locked by a plug. It is unfavorable that for the production of the leakage chamber separate manufacturing steps are necessary.

SUMMARY OF THE INVENTION

It is the object of the present invention to overcome these deficiencies and to permit, in a cooling water pump of the type mentioned above, the provision of a leakage chamber in the simplest possible way.

According to the invention this object is achieved by designing the leakage chamber in such a way that it may be brought out of shape by a slider which is pulled in an essentially transverse direction and preferably normal to the plane on the axis of the pump shaft. Thanks to the slider which may be pulled in radial or tangential direction relative to the pump shaft, the leakage chamber, which is preferably arranged on the suction side, can be produced in one single operation. The slider is hereby shaped in such a way that it creates the communicating line between the leakage chamber and a connecting space located between the bearing and the rotating mechanical seal.

The opening is preferably arranged at the highest point of the leakage chamber—seen in the fitting position of the cooling water pump, the opening being preferably encompassed by a flange facing. The fitting position of the leakage chamber is hereby essentially directed diagonally upward so that no cooling water can leak through the leakage chamber. The water vapor however is free to pass the opening. In order to reliably prevent spillage when the vehicle is moving, the leakage chamber is designed as high as possible, the opening being preferably located at least partially above the axis of the pump shaft. In order to reliably prevent vapor from accumulating it is advantageous to have the cross section of the leakage chamber widening toward the opening.

In a preferred embodiment of the invention a leakage bore is provided which leads from the leakage chamber to the outside. Said leakage bore protects the bearing against overflowing cooling water in case of a failure of the rotating mechanical seal. The leakage bore is hereby preferably located underneath the center of the bearing so that overflowing cooling water may drain off the leakage chamber through the leakage bore. A particularly easy way of manufacturing is made possible when the leakage bore is arranged parallel to the axis of the pump shaft. Thus, the leakage bore may be shaped in the direction of the opening of the die casting tool for the casing.

The leakage chamber produced according to the invention may be provided for cooling water pumps having the suction chamber of the cooling water pump and the bearing located on the same side as well as for cooling water pumps in which the suction chamber and the bearing are arranged on different sides of the impeller.

BRIEF DESCRIPTION OF THE DRAWINGS

The invention is explained below in closer detail by reference to the enclosed drawings, wherein:

FIG. 1 shows a section through a cooling water pump according to the invention, FIG. 2 shows, seen from the drive side, a front view of the casing of the cooling water pump.

DETAILED DESCRIPTION OF THE PREFERRED EMBODIMENT

Figure 3:
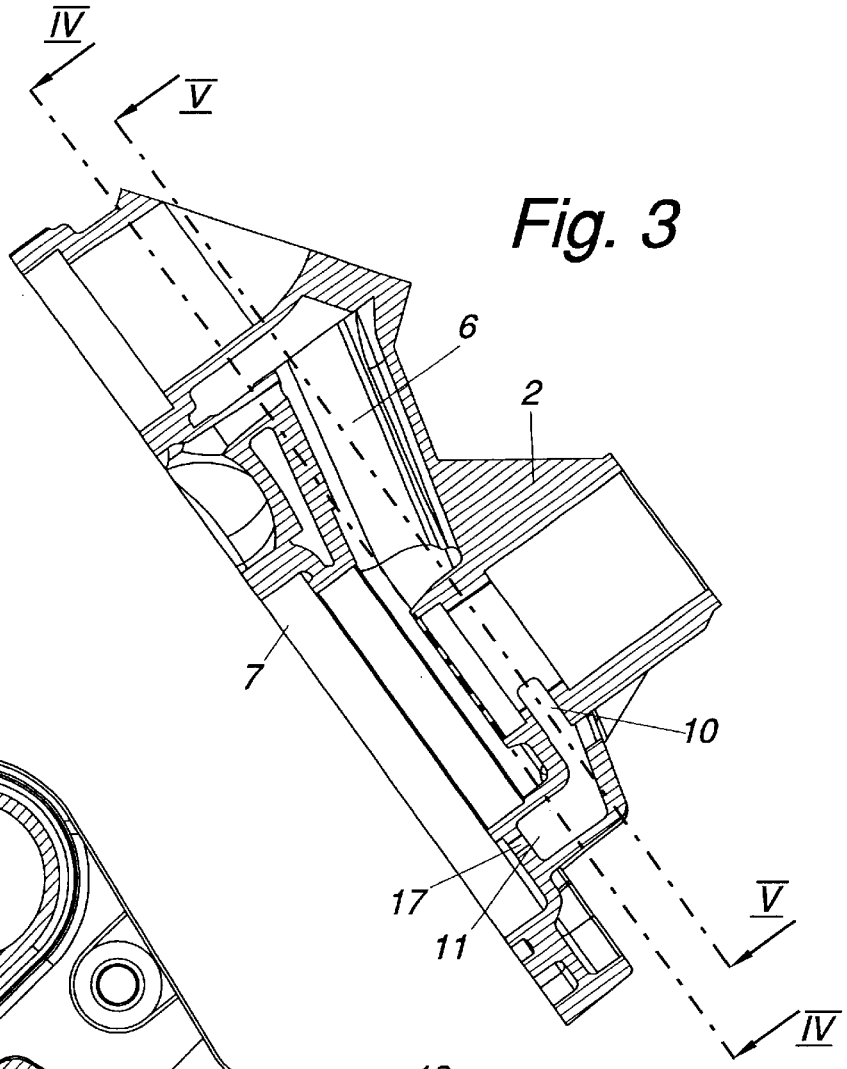
FIG. 3 shows a sectional view of the casing taken along the line III—III in FIG. 2.
Figure 4:
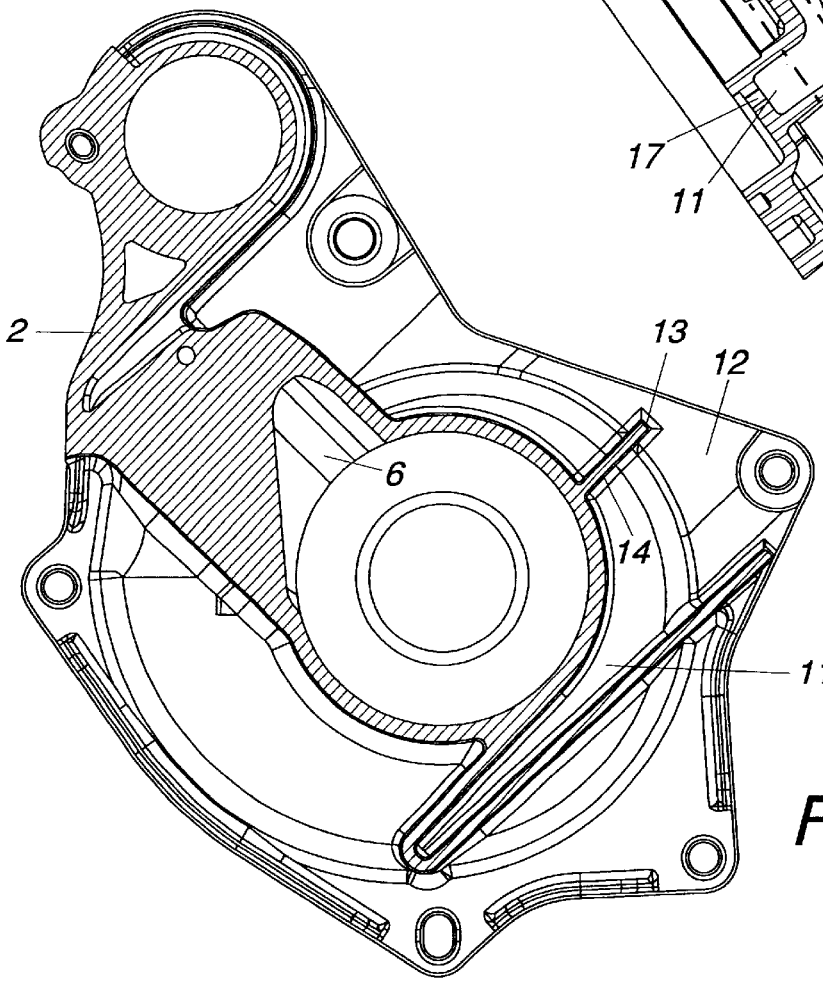
FIG. 4 shows a sectional view of the casing taken along the line IV—IV in FIG. 3
Figure 5:
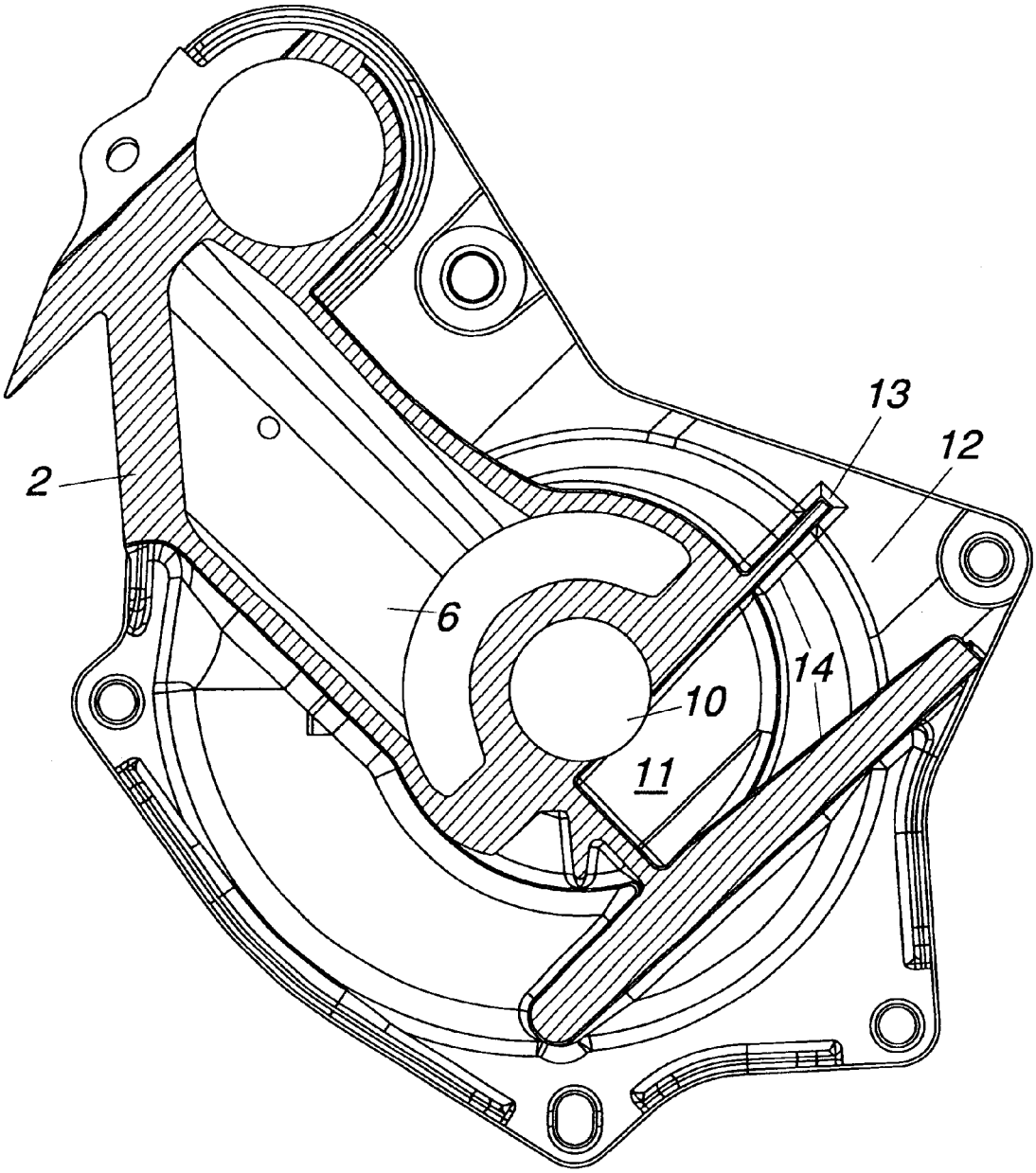
FIG. 5 shows a sectional view of the casing taken along the line V—V in FIG. 3.

The cooling water pump 1 illustrated in FIG. 1 is provided with a casing 2 in which a bearing 3 designed as a rolling bearing is disposed, the bearing rotatably carrying a pump shaft 4. An impeller 5 is mounted on the pump shaft 4 in a well-known manner. The impeller 5 draws the cooling agent, like cooling water for example, in a suction area 6 and throws it in radial direction into a pump chamber 7 defined in the casing 2. The pump chamber 7 is closed by a cover (not shown) as it is arranged on the casing 2.

A sealing element 8 is provided between the casing 2 and the pump shaft 4 and is designed to seal the cooling agent, said sealing element 8 being configured as a rotating mechanical seal for example. Thanks to this sealing element 8, the cooling agent is prevented from getting from the pump chamber 7 to the bearing 3 and from there to the outside. In the casing 2, a connecting space 9 is arranged between the sealing element 8 and the bearing 3, a communicating line 10 directed downward leaving said connecting space and leading into a leakage chamber 11 located on the suction side in the casing 2 as well. The leakage chamber 11 is provided at its highest point—seen in the fitting position of the water pump 1, with an opening 12 which is encompassed by a flange facing 13. The leakage chamber 11 is arranged in the casing 2 in such a way that its walls 14 are inclined, in the fitting position of the water pump 1, to a horizontal plane 15 as well as to a vertical axis 16.

The leakage chamber 11 may be created by a lateral slider which is pulled across the axis of the pump shaft 4*a*, preferably radially or tangentially to the pump shaft 4, i.e., preferably essentially normal to the plane 20 of the axis of the pump shaft 4*a*. The communicating line 10 may be created by the accordingly shaped slider as well. This considerably facilitates the creation of the leakage chamber 11.

A predetermined quantity of cooling agent can be collected in the leakage chamber 11. The cooling agent, collected in the leakage chamber 11 and heated by the heat of the bearing, can evaporate through the opening 12. In order to ease the exit of vapor, the leakage chamber 11 has been given a shape such that the walls 14 are widening toward the opening 12.

In order to prevent spillage of the collected cooling agent from the opening 12 when the vehicle is moving, the leakage chamber 11 is designed as high as possible, the opening 12 being preferably located at least partially above the level of the axis of the pump shaft 4*a*—seen in a normal plane 20 on the axis of the pump shaft 4*a*. In order to protect the bearing 3 against overflowing cooling water, the casing 2 is provided with a leakage bore 17 which is designed in direction of the axis of the pump shaft 4*a* and which leads from the leakage chamber 11 to the outside. The leakage bore is hereby preferably located underneath a horizontal plane 15*a* which is running through the center of the bearing 3*a*. The cooling agent can drain to the outside through this leakage bore 17. The leakage bore 17 may be produced together with the casing 2 by the die casting tool for the casing 2.

In the embodiment, the suction area 7 of the cooling water pump 1 is located on the same side of the impeller 5 as the bearing 3 and the sealing element 8. The leakage chamber 11 created according to the invention can of course also be used on cooling water pumps 2 having the suction area 6 and the sealing element 8 located on different sides of the impeller 5.

The present invention makes it possible to considerably ease the manufacture of a cooling water pump 1.

What is claimed is:

1. A method for manufacturing a cooling water pump for an internal-combustion engine with a casing provided with at least one bearing designed to support a pump shaft, with a sealing element devised to seal the bearing against a working space containing a cooling agent as well as with a leakage chamber arranged in the casing and receiving the cooling agent that leaks through the sealing element, comprising the steps of molding the casing so as to include a cavity as the leakage chamber, and pulling a slider in a direction essentially normal to a plane on an axis of the pump shaft to bring the leakage chamber out of shape.

2. The method according to claim 1, wherein the leakage chamber has an opening to the outside, wherein the opening is arranged at the highest point of the leakage chamber—seen in the fitting position of the cooling water pump.

3. The method according to claim 2, wherein the opening is encompassed by a flange facing.

4. The method according to claim 1, wherein a leakage bore is provided which leads from the leakage chamber to the outside.

5. The method according to claim 4, wherein the leakage bore—seen in the fitting position of the cooling water pump—is arranged so as to lie deeper than the center of the bearing.

6. The method according to claim 4, wherein the leakage bore is arranged parallel to the axis of the pump shaft.

7. The method according to claim 3, wherein the cross section of the leakage chamber widens toward the opening.

8. The method according to claim 1, wherein the leakage chamber is arranged on a suction side of the pump.

* * * * *